US010482867B2

(12) United States Patent
Yano

(10) Patent No.: US 10,482,867 B2
(45) **Date of Patent: *Nov. 19, 2019**

(54) ACTIVE VIBRATION NOISE CONTROL APPARATUS

(71) Applicant: MITSUBISHI ELECTRIC CORPORATION, Tokyo (JP)

(72) Inventor: Atsuyoshi Yano, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/544,485

(22) PCT Filed: Mar. 24, 2015

(86) PCT No.: PCT/JP2015/001646

§ 371 (c)(1),
(2) Date: Jul. 18, 2017

(87) PCT Pub. No.: WO2016/151624

PCT Pub. Date: Sep. 29, 2016

(65) Prior Publication Data

US 2017/0365246 A1 Dec. 21, 2017

(51) Int. Cl.
*G10K 11/16* (2006.01)
*G10K 11/178* (2006.01)

(52) U.S. Cl.
CPC ..... *G10K 11/178* (2013.01); *G10K 11/17883* (2018.01); *G10K 2210/121* (2013.01); (Continued)

(58) Field of Classification Search
CPC ..... H04R 2499/00; H04R 2499/01; H04R 2499/10; H04R 2499/11; H04R 2499/13; (Continued)

(56) References Cited

U.S. PATENT DOCUMENTS 5,170,433 A * 12/1992 Elliott ..... G10K 11/178 704/226
2004/0247137 A1 12/2004 Inoue et al.
(Continued)

FOREIGN PATENT DOCUMENTS

EP 2043383 A1 4/2009
JP 2004-361721 A 12/2004
(Continued)

*Primary Examiner* — Leshui Zhang
(74) *Attorney, Agent, or Firm* — Birch, Stewart, Kolasch & Birch, LLP

(57) ABSTRACT

There are provided a control signal generation unit 120 that generates a control signal on the basis of a cosine wave signal and a sine wave signal whose frequencies are a control frequency identified according to a vibration noise source, and a correction value update unit that updates a correction value to a value for decreasing signal power of an error signal on the basis of a relationship between increase and decrease of the signal power of the error signal obtained from remaining vibration noise that remains after interference sound that is generated on the basis of the control signal and propagates through a secondary route interferes with vibration noise generated from the vibration noise source and increase and decrease of the correction value used for correction of the control frequency.

4 Claims, 3 Drawing Sheets

(52) U.S. Cl.
CPC ..... *G10K 2210/129* (2013.01); *G10K 2210/1282* (2013.01); *G10K 2210/3044* (2013.01)

(58) Field of Classification Search
CPC ..... H04R 2499/15; H04R 2410/00; H04R 2410/01; H04R 2410/03; H04R 2410/05; H04R 2410/07; G10L 21/0208; G10L 2021/02082; G10L 2021/02085; G10L 2021/02087; G10L 2021/0216; G10L 2021/02161; G10L 2021/0163; G10L 2021/02165; G10L 2021/02166; G10L 2021/02168; G10L 21/0232; G10L 21/0264; G10L 21/0272; G10L 21/028; G10L 21/0308; G10L 21/038; G10L 21/0388; G10L 21/043; G10L 21/045; G10L 21/057; G10L 2021/0575; G10L 2021/065; G10K 11/00; G10K 11/002; G10K 11/172; G10K 11/175; G10K 11/178; G10K 11/1781; G10K 11/17813; G10K 11/17815; G10K 11/17817; G10K 11/17819; G10K 11/17821; G10K 11/17823; G10K 11/17825; G10K 11/17853; G10K 11/17854; G10K 11/17875; G10K 11/17879; G10K 11/17881; G10K 11/17883
USPC ..... 381/17, 18, 19, 20, 21, 300, 301, 302, 381/303, 307, 119, 66, 27, 71.1–71.6, 381/71.9, 71.11, 71.12, 26, 318, 86, 92, 381/94.1, 93, 95, 96, 98, 99, 100, 101, 381/102, 103, 122, 123; 700/94; 379/406.01–406.16; 455/569.1, 570; 704/E19.014, E21.001–E21.016, E21.018
See application file for complete search history.

(56) References Cited

U.S. PATENT DOCUMENTS

| | | | | |
|---|---|---|---|---|
| 2008/0118083 | A1* | 5/2008 | Mitsuhata | H04B 15/00 381/94.3 |
| 2011/0280410 | A1 | 11/2011 | Matono et al. | |
| 2013/0136269 | A1* | 5/2013 | Sakamoto | G10K 11/178 381/71.4 |
| 2015/0086031 | A1* | 3/2015 | Goto | G10K 11/178 381/71.8 |
| 2015/0269924 | A1 | 9/2015 | Yano | |

FOREIGN PATENT DOCUMENTS

| | | | |
|---|---|---|---|
| JP | 2006-308809 | A | 11/2006 |
| JP | 2010-167844 | A | 8/2010 |
| WO | WO 2014/068624 | A1 | 5/2014 |

* cited by examiner

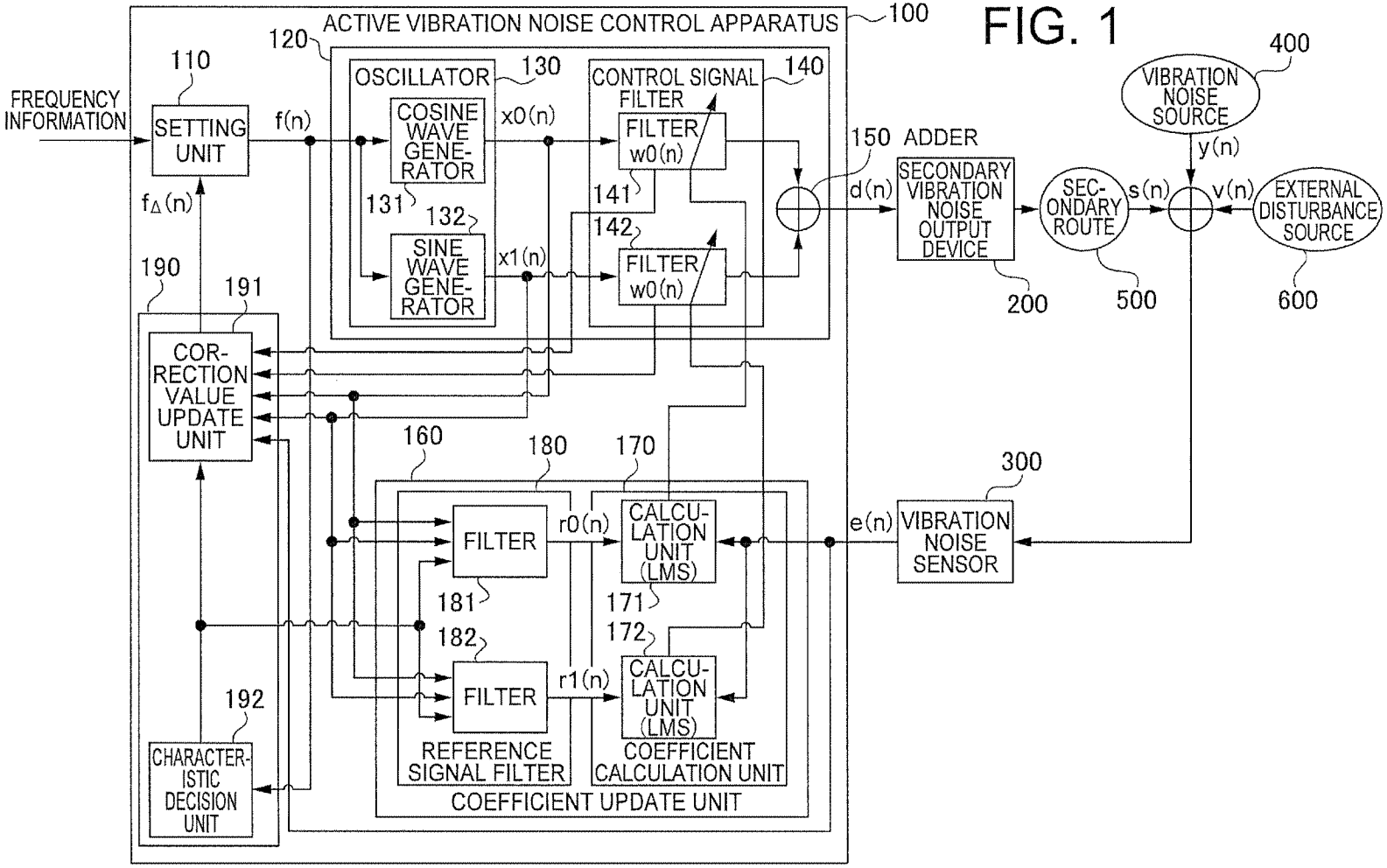
FIG. 1
ACTIVE VIBRATION NOISE CONTROL APPARATUS
100
VIBRATION NOISE SOURCE
400
y(n)
EXTERNAL DISTURBANCE SOURCE
600
v(n)
s(n)
SEC-ONDARY ROUTE
500
SECONDARY VIBRATION NOISE OUTPUT DEVICE
200
ADDER
150
d(n)
VIBRATION NOISE SENSOR
300
e(n)
CONTROL SIGNAL FILTER
140
FILTER w0(n)
141
FILTER w0(n)
142
OSCILLATOR
130
COSINE WAVE GENE-RATOR
131
SINE WAVE GENE-RATOR
132
x0(n)
x1(n)
120
f(n)
SETTING UNIT
110
FREQUENCY INFORMATION
fΔ(n)
CALCU-LATION UNIT (LMS)
170
171
CALCU-LATION UNIT (LMS)
172
COEFFICIENT CALCULATION UNIT
r0(n)
r1(n)
FILTER
180
181
FILTER
182
REFERENCE SIGNAL FILTER
COEFFICIENT UPDATE UNIT
160
COR-RECTION VALUE UPDATE UNIT
190
191
CHARACTER-ISTIC DECISION UNIT
192

FIG. 4

| FREQUENCY | TRANSFER CHARACTERISTIC |
|---|---|
| $F_{m-1} \leqq f$ | $C0_m$, $C1_m$ |
| ⋮ | ⋮ |
| $f_1 \leqq f < f_2$ | $C0_2$, $C1_2$ |
| $0 \leqq f < f_1$ | $C0_1$, $C1_1$ |

ACTIVE VIBRATION NOISE CONTROL APPARATUS

TECHNICAL FIELD

The present invention relates to an active vibration noise control technology that reduces vibration noise by secondary vibration noise generated according to the vibration noise.

BACKGROUND ART

An active vibration noise control apparatus (Active Noise Control Apparatus) that uses an adaptive notch filter (Adaptive Notch Filter) is known as a device that reduces vibration noise generated by a rotary machine such as an engine. Here, the vibration noise indicates vibration or noise generated by operation of a machine or the like. This active vibration noise control apparatus sets a frequency of the vibration noise identified from a rotation period of the rotary machine as a control frequency, generates a control signal in antiphase to the vibration noise of the control frequency, and outputs this as a secondary vibration noise, thereby reducing the vibration noise by interference between the vibration noise and the secondary vibration noise.

In this case, there arises a problem in which an effect of reducing the vibration noise becomes smaller when a difference is generated between a frequency of actual vibration noise and a control frequency, due to influence of an error in measurement by a period sensor that detects the rotation period of the rotary machine, a delay of a signal that reports a measurement value from the period sensor, or the like. To cope with this problem, there is proposed a method (patent reference 1) that corrects the control frequency according to change of an argument when a filter coefficient of the adaptive notch filter is expressed on a complex plane as a real part and an imaginary part of a complex number, and there is proposed a method (patent reference 2) that corrects the control frequency on the basis of the control signal on the basis of a difference between a frequency of the control signal after updating a filter coefficient obtained by the adaptive notch filter and the control frequency.

PRIOR ART REFERENCE

Patent Reference

PATENT REFERENCE 1: Japanese Patent Application Publication No. 2010-167844 (FIG. 1)

PATENT REFERENCE 2: International Publication WO 2014/068624 (FIG. 1)

SUMMARY OF THE INVENTION

Problem to be Solved by the Invention

However, in a case where there is other vibration noise (external disturbance) from a vibration noise source (external disturbance source) other than the rotary machine which is a vibration noise control target, the filter coefficient of the adaptive notch filter is not updated appropriately due to the influence of the external disturbance in some cases if a cancellation error that remains after the interference between the vibration noise and the secondary vibration noise becomes close to an amplitude level of the external disturbance for example. In this case, a conventional active vibration noise control apparatus that decides a correction value of the control frequency on the basis of change of the filter coefficient of the adaptive notch filter or the control signal generated according to the updated filter coefficient has a problem of being unable to correctly correct the control frequency.

The present invention is made to solve the above problem and has a purpose of obtaining an active vibration noise control apparatus that is capable of appropriately correcting the control frequency identified as the frequency of the vibration noise which is the control target and improves an effect of reducing the vibration noise even in a case where other vibration noise exists as external disturbance in addition to the vibration noise which is the control target.

Means for Solving the Problem

An active vibration noise control apparatus of the present invention includes a control signal generation unit that generates a control signal on a basis of a cosine wave signal and a sine wave signal whose frequencies are a control frequency identified according to a vibration noise source; and a correction value update unit that updates a correction value to a value for decreasing signal power of an error signal, on a basis of a relationship between increase and decrease of the signal power of the error signal and increase and decrease of the correction value used for correction of the control frequency, the error signal being obtained from remaining vibration noise that remains after interference sound that is generated on a basis of the control signal and propagates through a secondary route interferes with vibration noise generated from the vibration noise source.

Effects of the Invention

According to the active vibration noise control apparatus of the present invention, when the control frequency identified as the frequency of the vibration noise generated from the vibration noise source is corrected with the correction value, the control frequency is corrected by using the correction value updated to the value for decreasing the signal power of the error signal on the basis of the relationship between the increase and decrease of the signal power of the error signal obtained by detecting the remaining vibration noise that remains by the interference between the vibration noise and the secondary vibration noise and the increase and decrease of the correction value of the control frequency, and thus the difference between the frequency of the vibration noise and the control frequency can be decreased by correcting the control frequency with the correction value for decreasing the signal power of the error signal obtained by detecting the remaining vibration noise, even in a case where external disturbance other than the vibration noise which is the control target is included in the remaining vibration noise.

BRIEF DESCRIPTION OF THE DRAWINGS

FIG. 1 is a block diagram illustrating an example of a functional configuration of an active vibration noise control apparatus according to a first embodiment of the present invention.

FIG. 4 is a table illustrating an example of a storage fo it of transfer characteristics of a secondary route stored in the active vibration noise control apparatus of the first embodiment of the present invention.

MODE FOR CARRYING OUT THE INVENTION

Figure 2:
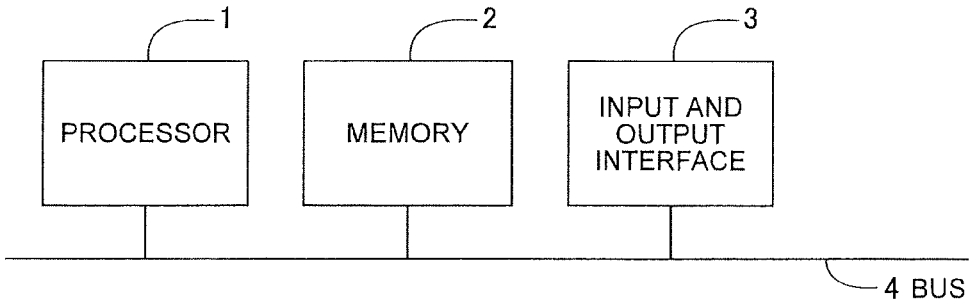
FIG. 2 is a block diagram illustrating an example of a hardware configuration of the active vibration noise control apparatus of the first embodiment of the present invention.

In the following, an embodiment of the present invention will be described with reference to drawings.

First Embodiment

FIG. 1 is a block diagram illustrating an example of a functional configuration of an active vibration noise apparatus according to a first embodiment of the present invention. The active vibration noise control apparatus 100 of the present embodiment is connected to a secondary vibration noise output device 200 and a vibration noise sensor 300 which are provided outside. Frequency information of vibration noise generated from a vibration noise source 400 which is a control target is input from the outside into the active vibration noise control apparatus 100, and the active vibration noise control apparatus 100 outputs a control signal d(n) generated on the basis of the input frequency information. n is a variable representing a discrete time in digital signal processing. Incidentally, the control signal d(n) output from the active vibration noise control apparatus 100 may be a signal suitable for an actual implementation form, such as an electrical signal and a light signal.

The frequency information of the vibration noise in the above is information for identifying the frequency of the vibration noise, such as a rotation frequency of an engine when the vibration noise source 400 is an engine of an automobile, for example. This frequency information can be acquired by using a rotation sensor, for example by measuring the rotation frequency of the engine from an ignition pulse period in the case of the rotation frequency of the engine. Moreover, identification of the frequency of the vibration noise based on the frequency information can be achieved by a method such as multiplying the rotation frequency by a certain number according to a rotation order of the engine in the case of the vibration noise of the engine. When the vibration noise source 400 is a fan driven by an electrically driven motor, the frequency of the vibration noise (NZ sound) which is the target can be calculated with the number of poles of the motor, a power supply frequency, the number of blades of the fan, or the like as the frequency information. As described above, for the acquisition of the frequency information of the vibration noise and the identification of the frequency of the vibration noise based on the frequency information, a means suitable for the generation source of the vibration noise which is the vibration noise control target may be used as appropriate. Incidentally, in the following, the frequency of the vibration noise identified on the basis of the frequency information corresponding to the vibration noise source 400 is referred to as a control frequency.

The secondary vibration noise output device 200 connected to the active vibration noise control apparatus 100 in FIG. 1 generates and outputs secondary vibration noise for canceling the vibration noise y(n) generated from the vibration noise source 400 by using the control signal d(n) output by the active vibration noise control apparatus 100, and can be configured with a speaker, an actuator, or the like, for example.

The secondary vibration noise output by the secondary vibration noise output device 200 propagates through a secondary route 500 and interferes with the vibration noise generated from the vibration noise source 400 to reduce the vibration noise. Here, the secondary route 500 is defined as a route that the secondary vibration noise output by the secondary vibration noise output device 200 passes through while propagating to the vibration noise sensor 300. In FIG. 1, s(n) indicates the secondary vibration noise that has propagated through the secondary route 500.

Moreover, the vibration noise sensor 300 detects remaining vibration noise which is a result of the interference between the vibration noise y(n) and the secondary vibration noise s(n), outputs the detected remaining vibration noise as an error signal e(n) to the active vibration noise control apparatus 100, and can be configured with a microphone, a vibration sensor, an acceleration sensor, or the like, for example. Incidentally, an input of the error signal e(n) to the active vibration noise control apparatus 100 may be performed by an electrical signal, a light signal, or the like.

Here, external disturbance which is vibration noise generated from an external disturbance source 600, as well as the vibration noise y(n) which is the control target, is superposed on the error detected by the vibration noise sensor 300. Incidentally, the external disturbance source 600 is a generation source of vibration noise other than the vibration noise source 400, and is not limited to a specific generation source of vibration noise.

Next, detail of the configuration of the active vibration noise control apparatus 100 of the present embodiment will be described. The active vibration noise control apparatus 100 includes a setting unit 110, a control signal generation unit 120, a coefficient update unit 160, and a correction value decision unit 190.

Moreover, FIG. 1 illustrates an example of detailed functional configurations of the control signal generation unit 120, the coefficient update unit 160, and the correction value decision unit 190. In FIG. 1, the control signal generation unit 120 includes an oscillator 130, a control signal filter 140, and an adder 150. Further, the oscillator 130 includes a cosine wave generator 131 and a sine wave generator 132. Moreover, the control signal filter 140 includes a filter 141 and a filter 142. Incidentally, w0($n$) and w1($n$) indicate filter coefficients of the filter 141 and the filter 142, respectively.

Moreover, the coefficient update unit 160 includes a coefficient calculation unit 170 and a reference signal filter 180. Then, the coefficient calculation unit 170 includes a calculation unit 171 and a calculation unit 172, and the reference signal filter 180 includes a filter 181 and a filter 182. Here, LMS indicates that the calculation unit 171 and the calculation unit 172 use an LMS (Least-Mean-Square) algorithm as an adaptive algorithm. Incidentally, the LMS algorithm is an example of the adaptive algorithm, and the present invention does not limit the adaptive algorithm to the LMS algorithm.

Moreover, the correction value decision unit 190 includes a correction value update unit 191 and a characteristic decision unit 192.

The setting unit 110 sets the control frequency f(n) to the oscillator 130 of the control signal generation unit 120 on the basis of the frequency information input from the outside and a correction value $f_{\Delta}(n)$ of the control frequency input from the correction value update unit 191 of the correction value decision unit 190. Moreover, the setting unit 110 also sets the control frequency f(n) to the characteristic decision unit 192 of the correction value decision unit 190.

The cosine wave generator 131 and the sine wave generator 132 of the oscillator 130 generate a cosine wave signal x0($n$) and a sine wave signal x1($n$) according to the control frequency f(n) set from the setting unit 110, respectively. The oscillator 130 inputs the generated cosine wave signal x0($n$) and the sine wave signal x1($n$) into the control signal filter 140. Moreover, the cosine wave signal x0($n$) and the sine wave signal x1($n$) are also input into the reference signal filter 160 of the coefficient update unit 160 and the correction value update unit 191 of the correction value decision unit 190.

The filter 141 included in the control signal filter 140 performs a filtering process to the cosine wave signal x0($n$). In this case, a filter coefficient (first filter coefficient) used for the filtering process is w0($n$). In the same way, the filter 142 performs a filtering process to the sine wave signal x1($n$). In this case, a filter coefficient (second filter coefficient) used for the filtering process is w1($n$). The adder 150 adds two signals (x0($n$)·w0($n$) and x1($n$)·w1($n$), where "·" represents multiplication) to which the filtering processes are performed by the control signal filter 140, and thereby generates the control signal d(n).

The characteristic decision unit 192 stores transfer characteristics of the secondary route 500 determined for individual frequencies, decides a transfer characteristic corresponding to the input control frequency f(n) from among the stored transfer characteristics, and outputs the transfer characteristic as a secondary route characteristic parameter. The transfer characteristics of the secondary route 500 stored in the characteristic decision unit 192 may be acquired for example by measuring the characteristics of respective frequencies in advance and be stored in the characteristic decision unit 192. Moreover, the storage of the transfer characteristics may be performed for example by storing the transfer characteristics in a non-volatile memory or storing by incorporating the storage in a circuit. The secondary route characteristic parameter output by the characteristic decision unit 192 is input into the reference signal filter 180 of the coefficient update unit 160 and the correction value update unit 191.

The reference signal filter 180 generates a first reference signal r0($n$) and a second reference signal r1($n$) on the basis of the cosine wave signal x0($n$), the sine wave signal x1($n$), and the secondary route characteristic parameter output by the characteristic decision unit 192. Specifically, the filter 181 generates the first reference signal r0($n$), and the filter 182 generates the second reference signal r1($n$).

The coefficient calculation unit 170 updates the filter coefficients of the control signal filter 140 of the control signal generation unit 120 by the LMS algorithm, on the basis of the first reference signal r0($n$), the second reference signal r1($n$), and the error signal e(n) from the vibration noise sensor 300. Specifically, the calculation unit 171 included in the coefficient calculation unit 170 calculates and updates the first filter coefficient w0($n$) on the basis of the first reference signal r0($n$) and the error signal e(n). Moreover, the calculation unit 172 calculates and updates the second filter coefficient w1($n$) on the basis of the second reference signal r1($n$) and the error signal e(n).

The correction value update unit 191 decides the correction value $f_\Delta(n)$ for correcting the difference between the control frequency f(n) and the frequency of the vibration noise, on the basis of the error signal e(n) from the vibration noise sensor 300, the cosine wave signal x0($n$) and the sine wave signal x1($n$) input from the oscillator 130, the first filter coefficient w0($n$) and the second filter coefficient w1($n$) used by the control signal filter 140, and the secondary route characteristic parameter input from the characteristic decision unit 192. Incidentally, the first filter coefficient w0($n$) and the second filter coefficient w1($n$) may be output by the control signal filter 140 to the correction value update unit 191, or may be output by the coefficient update unit 160. Here, the control signal filter 140 outputs them.

The setting unit 110, the control signal generation unit 120, and the oscillator 130, the control signal filter 140, and the adder 150 which are included in the control signal generation unit 120, the coefficient update unit 160, and the coefficient calculation unit 170 and the reference signal filter 180 which are included in the coefficient update unit 160, the correction value decision unit 190, and the correction value update unit 191 and the characteristic decision unit 192 which are included in the correction value decision unit 190, which are the blocks included in the above active vibration noise control apparatus 100, can be configured with hardware that uses an ASIC (Application Specific Integrated Circuit) or the like, and can be configured with a processor and a program that operates on the processor. Alternatively, they can be configured by combining hardware and a processor, such as an LSI, and a program that operates on the processor.

FIG. 2 is a block diagram illustrating an example of a hardware configuration when the active vibration noise control apparatus 100 of the present embodiment is configured with a processor and programs executed by the processor. The programs that provide the functions of the blocks composing the active vibration noise control apparatus 100 illustrated in FIG. 1 are stored in a memory 2, and the stored programs are executed in a processor 1 by using the memory 2. Input of the frequency information, output of the control signal d(n) to the secondary vibration noise output device 200, input of the error signal e(n) output by the vibration noise sensor 300, etc., which are illustrated in FIG. 1, are performed via an input and output interface 3. Incidentally, a plurality of input and output interfaces 3 may be provided, depending on connected devices. A bus 4 interconnects between the processor 1, the memory 2, and the input and output interface 3. Incidentally, the bus 4 may be configured by using a bus bridge or the like as appropriate.

Figure 3:
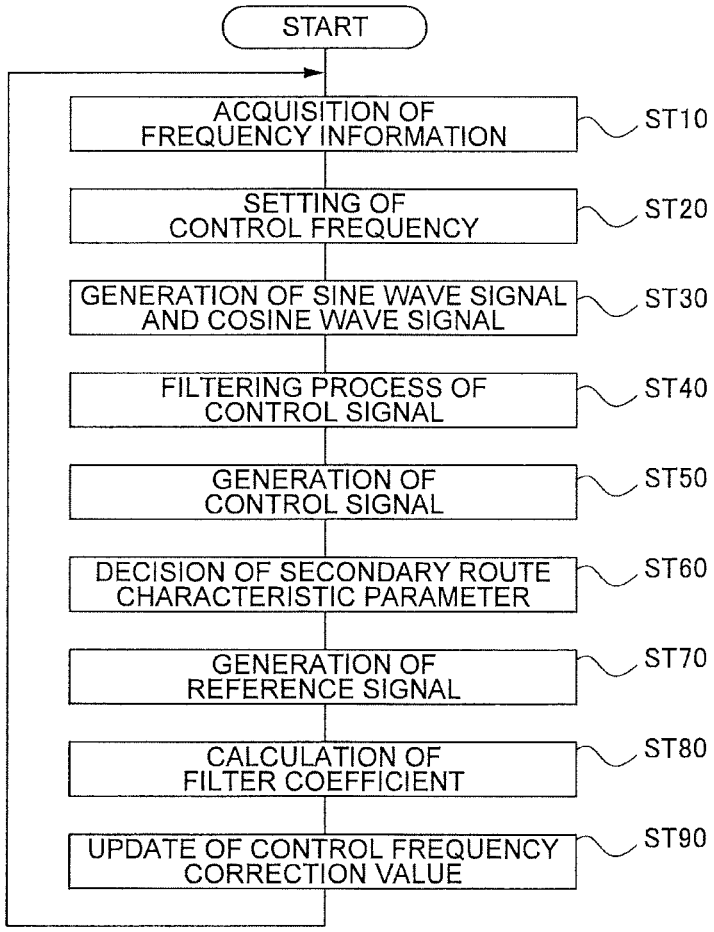
FIG. 3 is a flow diagram illustrating an example of a process flow of the active vibration noise control apparatus of the first embodiment of the present invention.

Next, operation of the active vibration noise control apparatus 100 of the first embodiment will be described. FIG. 3 is a flow diagram illustrating an example of a process flow of the active vibration noise control apparatus 100. Incidentally, the present invention is not limited to the flow diagram of FIG. 3, and the processes may be performed in a different order or a part of the processes may be parallelized, as long as an equivalent result is obtained.

First, the setting unit 110 of the active vibration noise control apparatus 100 acquires the frequency information of the vibration noise which is input from the outside (ST10). Then, the setting unit 110 calculates the control frequency f(n) from the acquired frequency information and the correction value $f_\Delta(n)$, and sets the control frequency f(n) in the oscillator 130 and the characteristic decision unit 192 (ST20). Detail of the correction value $f_\Delta(n)$ will be described later. Regarding how to calculate the control frequency f(n), it can be determined as in the following expression 1 for example, on the basis of the frequency F(n) calculated from the frequency information of the vibration noise and the correction value $f_\Delta(n)$. Incidentally, the frequency F(n) may be calculated as appropriate by a method suitable for the vibration noise source 400 and the obtained frequency information, such as multiplying the rotation speed of the engine, which is the frequency information, by a certain number as described above.

$$f(n)=F(n)+f_\Delta(n) \tag{1}$$

In a case where there is no difference between the frequency F(n) calculated from the frequency information and the control frequency f(n), in a case immediately after the apparatus starts operating, or the like, a situation in which the correction value becomes $f_\Delta(n)=0$ and f(n)=F(n) can also occur.

Next, the cosine wave generator 131 and the sine wave generator 132 of the oscillator 130 generate the cosine wave signal x0(*n*) and the sine wave signal x1(*n*) whose frequencies are the control frequency f(n), respectively (ST30). The signal that has a waveform of a cosine wave (or sine wave) can be generated by using an oscillation element for example, and can be generated by calculating a signal value at each discrete time by the processor or the like for example.

Next, the control signal filter 140 performs the filtering processes of the control signal to the cosine wave signal x0(*n*) and the sine wave signal x1(*n*) (ST40). Specifically, the filter 141 performs the process for multiplying the cosine wave signal x0(*n*) by the first filter coefficient w0(*n*), and the filter 142 performs the process for multiplying the sine wave signal x1(*n*) by the second filter coefficient w1(*n*). Then, the adder 150 generates the control signal d(n) by adding the cosine wave signal w0(*n*)·x0(*n*) to which the filtering process is performed and the sine wave signal w1(*n*)·x1(*n*) to which the filtering process is performed (ST50). The control signal d(n) can be expressed by the following expression 2.

$$d(n)=w0(n)\cdot x0(n)+w1(n)\cdot x1(n) \tag{2}$$

The control signal d(n) generated by the active vibration control apparatus 100 is converted to the secondary vibration noise by the secondary vibration noise output device 200. Then, the secondary vibration noise output by the secondary vibration noise output device 200 propagates through the secondary route 500 and interferes with the vibration noise y(n) generated from the vibration noise source 400. In the following, the secondary vibration noise influenced by the transfer characteristic of the secondary route 500 is referred to as interference sound. The interference sound is represented by s(n) in FIG. 1. The interference sound s(n) interferes with the vibration noise y(n) generated from the vibration noise source 400, and thereby the vibration noise y(n) is reduced.

The characteristic decision unit 192 stores the transfer characteristics of the secondary route 500 corresponding to frequencies as the secondary route characteristic parameters, and decides the secondary route characteristic parameter that corresponds to the control frequency f(n) when the control frequency f(n) is set (ST60). The secondary route characteristic parameters include a first parameter C0(*f*(*n*)) and a second parameter C1(*f*(*n*)). Then, it is assumed that an amplitude response (gain) γ(f) and a phase response ρ(f) of the secondary route 500 in the frequency f at a certain time point n are expressed with the first parameter C0(*f*) and the second parameter C1(*f*) by the following expression 3 and expression 4, respectively. Here, a tan indicates arc tangent. It is conceived that the characteristic decision unit 192 stores the transfer characteristics of the secondary route 500 for the respective frequencies in a table structure illustrated in FIG. 4, for example. FIG. 4 is an example that stores the transfer characteristics of m frequency bands (m is an integer equal to or greater than 2).

$$\gamma(f(n)) = \sqrt{C0^2(n) + C1^2(n)} \tag{3}$$

$$\rho(f(n)) = \operatorname{atan}\frac{C1(n)}{C0(n)} \tag{4}$$

Next, the reference signal filter 180 of the coefficient update unit 160 generates the reference signals on the basis of the cosine wave signal x0(*n*) and the sine wave signal x1(*n*) (ST70). Specifically, the filter 181 generates the first reference signal r0(*n*) expressed by the following expression 5 from the cosine wave signal x0(*n*), the sine wave signal x1(*n*), the first parameter C0(*f*(*n*)), and the second parameter C1(*f*(*n*)). Moreover, the filter 182 generates the second reference signal r1(*n*) expressed by the following expression 6 in the same way. Incidentally, in the following, the first parameter C0(*f*(*n*)) and the second parameter C1(*f*(*n*)) are simply described and expressed as C0(*n*) and C1(*n*) respectively.

$$r0(n)=C0(n)\cdot x0(n)-C1(n)\cdot x1(n) \tag{5}$$

$$r1(n)=C1(n)\cdot x0(n)+C0(n)\cdot x1(n) \tag{6}$$

Next, the coefficient calculation unit 170 calculates the filter coefficients of the control signal filter 140.

Specifically, the calculation unit 171 calculates a value for updating the first filter coefficient w0(*n*) so as to minimize the error signal e(n) by an MSE (mean square error) rule by the LMS algorithm, from the first reference signal r0(*n*) and the error signal e(n) from the vibration noise sensor 300 (ST80). In the same way, the calculation unit 172 calculates a value for updating the second filter coefficient w1(*n*) so as to minimize the error signal e(n) from the second reference signal r1(*n*) and the error signal e(n). The update of the filter coefficients can be expressed by the following expression 7 and expression 8.

$$w0(n+1)=w0(n)+\mu\cdot r0(n)\cdot e(n) \tag{7}$$

$$w1(n+1)=w1(n)+\mu\cdot r1(n)\cdot e(n) \tag{8}$$

Here, μ is an update step size for adjusting the adaptability of the adaptive filter, and is a value determined in advance on the basis of experiments or the like for example.

Next, the correction value update unit 191 updates the correction value $f_\Delta(n)$ of the control frequency so as to decrease signal power $e^2(n)$ of the error signal, on the basis of the cosine wave signal x0(*n*) and the sine wave signal x1(*n*) input from the oscillator 130, the error signal e(n) input from the vibration noise sensor 300, the first filter coefficient w0(*n*) and the second filter coefficient w1(*n*) input from the control signal filter 140, and the first parameter C0(*n*) and the second parameter C1(*n*) input from the characteristic decision unit 192 (ST90). The update of the correction value $f_\Delta(n)$ is expressed by the following expression 9, for example.

$$f_\Delta(n+1)=f_\Delta(n)-\alpha\cdot e(n)\cdot\{D1(n)\cdot x0(n)-D0(n)\cdot x1(n)\} \tag{9}$$

Here, α is a constant for determining the speed of the update, and satisfies α>0. Moreover, D0(*n*) and D1(*n*) indicate a component (cosine wave amplitude) of the cosine wave signal x0(*n*) and a component (sine wave amplitude) of the sine wave signal x1(*n*) of the interference sound s(n) respectively, which are calculated on the basis of the secondary route characteristic parameter and the filter coefficients of the control signal filter 140. The cosine wave amplitude D0(*n*) and the sine wave amplitude D1(*n*) are expressed by the following expressions 10 and $$D0(n)=w0(n)\cdot C0(n)+w1(n)\cdot C1(n) \tag{10}$$

$$D1(n)=-w0(n)\cdot C1(n)+w1(n)\cdot C0(n) \tag{11}$$

The interference sound s(n) can be calculated by the following expression 12 by using the cosine wave amplitude D0(*n*) and the sine wave amplitude D1(*n*).

$$s(n)=D0(n)\cdot x0(n)+D1(n)\cdot x1(n) \tag{12}$$

Here, the reason why the signal power $e^2(n)$ of the error signal decreases by the update of the correction value $f_\Delta(n)$ of the control frequency based on the expression 9 will be described. The error signal e(n) is synthesis of the vibration noise y(n), the interference sound s(n), and the external disturbance v(n), and thus is expressed by the following expression 13.

$$e(n)=y(n)+s(n)+v(n) \tag{13}$$

The gradient of the signal power $e^2(n)$ of the error signal in relation to the correction value $f_\Delta(n)$ can be calculated by partially differentiating the signal power $e^2(n)$ of the error signal with respect to the correction value $f_\Delta(n)$. The error signal e(n) is expressed by the expression 13; in addition, the interference sound s(n) can be expressed by the above expression 12; and thus the signal power $e^2(n)$ of the error signal is partially differentiated with respect to the correction value $f_\Delta(n)$ to obtain the following expression 14.

$$\begin{aligned}\frac{\partial}{\partial f_\Delta}e^2(n) &= 2e(n)\cdot\frac{\partial}{\partial f_\Delta}s(n)\\ &= 2e(n)\cdot\left\{D0(n)\cdot\frac{\partial}{\partial f_\Delta}x0(n)-D1(n)\cdot\frac{\partial}{\partial f_\Delta}x1(n)\right\}\end{aligned} \tag{14}$$

The cosine wave signal $\mathbf{x0}(n)$ and the sine wave signal $\mathbf{x1}(n)$ are expressed by the following expressions 15 and 16, by using the frequency F(n) indicated by the frequency information and the correction value $f_\Delta(n)$.

$$x0(n)=\cos\{2\pi\cdot(F(n)+f_\Delta(n))/F_S+\theta(n-1)\} \tag{15}$$

$$x1(n)=\sin\{2\pi\cdot(F(n)+f_\Delta(n))/F_S+\theta(n-1)\} \tag{16}$$

Here, Fs indicates a sampling frequency of the cosine wave signal $\mathbf{x0}(n)$ and the sine wave signal $\mathbf{x1}(n)$, and θ(n−1) is a phase of the cosine wave signal $\mathbf{x0}(n)$ and the sine wave signal $\mathbf{x1}(n)$ at a time point n−1. Incidentally, θ(n) is expressed by a recurrence relation of the following expression 17.

$$\theta(n)=\theta(n-1)+2\pi(F(n)+f_\Delta(n))/F_S \tag{17}$$

Considering the expressions 15 and 16, the expression 14 can further be transformed as indicated in the following expression 18.

$$\frac{\partial}{\partial f_\Delta}e^2(n)\frac{4\pi}{F_s}\cdot e(n)\cdot\{D1(n)\cdot x0(n)-D0(n)\cdot x1(n)\}. \tag{18}$$

The expression 18 indicates change of the signal power $e^2(n)$ of the error signal in relation to minute change of the correction value $f_\Delta$, and whether the direction in which $f_\Delta(n)$ is changed minutely in relation to $f_\Delta(n-1)$ to change $e^2(n)$ in a decreasing direction is a positive direction or a negative direction is determined depending on the sign of the right side of the expression 18. It can be said that the expression 18 is an expression that expresses the relationship between increase and decrease of the correction value $f_\Delta$ and increase and decrease of the signal power $e^2(n)$ of the error signal. According to the expression 18, $e^2(n)$ decreases if $f_\Delta(n)$ is changed in a decreasing direction (negative direction) from $f_\Delta(n-1)$ when the right side of the expression 18 is positive, and if $f_\Delta(n)$ is changed in an increasing direction (positive direction) when the right side is negative. Here, a value (expression 19) obtained by removing 4π/Fs that is a positive constant on the right side of the expression 18 and does not influence the positive sign and the negative sign and reversing the positive sign and the negative sign of the remaining element is referred to as an update basic amount U(n).

$$U(n)=-e(n)\cdot\{D1(n)\cdot x0(n)-D0(n)\cdot x1(n)\} \tag{19}$$

The active noise control apparatus 100 of the present embodiment determines the correction value $f_\Delta(n)$ of the control frequency on the basis of the update basic amount U(n) indicated by the expression 19. The update method indicated in the above expression 9 is an example thereof. In the expression 9, the value obtained by multiplying U(n) by an arbitrary constant α is the change amount of the correction value $f_\Delta(n)$; the right side of the expression 18 is negative when U(n) is positive; then $f_\Delta(n+1)-f_\Delta(n)$ is positive in the expression 9; and thus the signal power $e^2(n)$ of the error signal decreases. Moreover, when U(n) is negative, the right side of the expression 18 is positive; then $f_\Delta(n+1)-f_\Delta(n)$ is negative in the expression 9; and thus in this case as well, the signal power $e^2(n)$ of the error signal decreases. Thus, the signal power $e^2(n)$ of the error signal decreases if the correction value $f_\Delta(n)$ is updated in accordance with the expression 9.

The error signal e(n) detected by the vibration noise sensor 300 becomes minimum when the control frequency f(n) accords with the frequency of the vibration noise y(n) from the vibration noise source 400. Thus, the control frequency f(n) is corrected so as to accord with the frequency of the actual vibration noise by updating the correction value $f_\Delta(n)$ of the control frequency so as to decrease the signal power $e^2(n)$ of the error signal as described above.

The active vibration noise control apparatus 100 of the present embodiment corrects the correction value $f_\Delta(n)$ of the control frequency so that the error signal e(n) becomes smaller, and thus can appropriately update the correction value $f_\Delta(n)$ even when the external disturbance v(n) is included in the error signal e(n).

Moreover, as illustrated in the expression 9, when the proportion of the change of the signal power $e^2(n)$ of the error signal to the change of the correction value $f_\Delta(n)$ is large, the change amount of the correction value $f_\Delta(n)$ is made larger so that the difference between the frequencies can be immediately eliminated; and when the proportion of the change of the signal power $e^2(n)$ of the error signal to the change of the correction value $f_\Delta(n)$ is small, the change amount of the correction value $f_\Delta(n)$ is made smaller so that the control frequency can be stabilized.

Although the active noise control apparatus 100 of the present embodiment determines the correction value $f_\Delta(n)$ on the basis of the expression 9, the present invention is not limited to this method. For example, the correction value $f_\Delta(n)$ may be updated by a predetermined update width β ((β>0) in accordance with the sign of the update basic amount U(n). That is, a method of updating as in the following expression 16 can also be considered.

$$f_\Delta(n+1)=\begin{cases} f_\Delta(n)-\beta, & U(n)<0\\ f_\Delta(n), & U(n)=0\\ f_\Delta(n)+\beta, & U(n)>0\end{cases}. \tag{20}$$

Moreover, it is also conceived that the constant α or β is a variable in the expression 9 and expression 20. In this case, the correction value $f_\Delta(n)$ can be updated according to an external condition, by changing α or β according to the external condition (for example, during traveling, during stopping, etc. in the case of an automobile), for example.

Further, it is also conceived that a restriction is placed on the correction value $f_\Delta(n)$ of the control frequency. The correction value $f_\Delta(n)$ may be allowed to change only within a predetermined range, to prevent excessive correction from being performed. For example, it is conceived that a correction range value ε is provided to place a restriction as illustrated in an expression 21. Moreover, a restriction may be placed on the change amount of the correction value.

$$|f_\Delta(n)|<\varepsilon \tag{21}$$

As above, when correcting the control frequency identified as the frequency of the vibration noise of the control target with the correction value, the active vibration noise apparatus of the first embodiment of the present invention corrects the control frequency by updating the correction value to decrease the signal power of the error signal, on the basis of the update basic amount indicated in the expression 19 which is obtained from the relationship between the increase and decrease of the correction value of the control frequency and the increase and decrease of the signal power of the error signal obtained by detecting the remaining vibration noise after the vibration noise of the control target interferes with the secondary vibration noise, which is indicated in the expression 18. As described above, decreasing the signal power of the error signal results in decreasing the difference between the control frequency and the frequency of the vibration noise, and therefore the active vibration noise apparatus of the first embodiment can decrease the difference between the frequency of the vibration noise of the control target and the control frequency, even when the external disturbance other than the vibration noise of the control target is included in the error signal obtained by detecting the remaining vibration noise.

Moreover, the relationship between the increase and decrease of the correction value of the control frequency and the increase and decrease of the signal power of the error signal is determined on the basis of the cosine wave signal, the sine wave signal, the filter coefficients of the control signal filter, and the transfer characteristics of the secondary route stored in the characteristic decision unit, and therefore the relationship between the increase and decrease of the correction value of the control frequency and the increase and decrease of the signal power of the error signal can be calculated without the influence of an external factor such as external disturbance. Moreover, the proportion of the change of the signal power of the error signal to the change of the correction value of the control frequency can be calculated more correctly, and the difference between the frequency of the vibration noise of the control target and the control frequency can be eliminated accurately.

Moreover, the magnitude of the change amount of the correction value is determined according to the magnitude of the change of the signal power of the error signal relative to the change of the correction value of the control frequency; thereby, when the difference between the frequency of the vibration noise of the control target and the control frequency is large and the remaining vibration noise is large, the change amount of the correction value is made larger so that the difference between the frequencies can be immediately eliminated; and when the difference is small and the remaining vibration noise is small, the change amount is made smaller so that the control frequency can be stabilized.

Moreover, by determining a correction range of the control frequency and determining the correction value within the range of the correction range, it is possible to avoid performing the excessive correction and making the effect of reducing the vibration noise unstable.

INDUSTRIAL APPLICABILITY

As above, the active vibration noise apparatus of the present invention can appropriately correct the control frequency identified as the frequency of the vibration noise of the control target even when there is the external disturbance source that generates the external disturbance which is other vibration noise that is not the control target in addition to the vibration noise source that generates the vibration noise of the control target, and thus is useful as an active vibration noise apparatus that is used in an environment with the external disturbance, such as an active vibration noise control apparatus that reduces the vibration noise of an engine of an automobile.

DESCRIPTION OF REFERENCE CHARACTERS

100 active vibration noise control apparatus; 110 setting unit; 120 control signal generation unit; 130 oscillator; 131 cosine wave generator; 132 sine wave generator; 140 control signal filter; 141 filter; 142 filter; 150 adder; 160 coefficient update unit; 170 coefficient calculation unit; 171 calculation unit; 172 calculation unit; 180 reference signal filter; 181 filter; 182 filter; 190 correction value decision unit; 191 correction value update unit; 192 characteristic decision unit; 200 secondary vibration noise output device; 300 vibration noise sensor; 400 vibration noise source; 500 secondary route; 600 external disturbance source.

What is claimed is:

1. An active vibration noise control apparatus comprising:

processing circuitry configured to operate as:

a control signal generation unit that generates a control signal on a basis of a cosine wave signal and a sine wave signal, where the frequencies of the cosine wave signal and sine wave signal are a control frequency identified according to a vibration noise source; and a correction value update unit that updates a correction value, for correcting a difference between the control frequency and a frequency of vibration noise, to a value for decreasing signal power of an error signal, on a basis of a relationship between increase and decrease of the signal power of the error signal and increase and decrease of the correction value used for correction of the control frequency, wherein the error signal is obtained from remaining vibration noise that remains after interference sound, that is generated on a basis of the control signal and propagates through a secondary route, interferes with the vibration noise generated from the vibration noise source, and the relationship between the increase and decrease of the signal power of the error signal and the increase and decrease of the correction value is obtained by partially differentiating the signal power of the error signal with respect to the correction value.

2. The active vibration noise control apparatus according to claim 1, wherein the correction value update unit determines the relationship between the increase and decrease of the signal power of the error signal and the increase and decrease of the correction value, on a basis of a cosine wave amplitude which is a component of the cosine wave signal of the interference sound, the component being calculated by using a predetermined transfer characteristic of the secondary route, a sine wave amplitude which is another component of the sine wave signal of the interference sound, the another component being calculated by using the transfer characteristic of the secondary route, the cosine wave signal, and the sine wave signal.

3. The active vibration noise control apparatus according to claim 1, wherein the correction value update unit updates the correction value according to a magnitude of a proportion of change of the signal power of the error signal to change of the correction value, so that a change amount of the correction value is made larger when the proportion of the change of the signal power of the error signal to the change of the correction value is large, and so that the change amount of the correction value is made smaller when the proportion of the change of the signal power of the error signal to the change of the correction value is small.

4. The active vibration noise control apparatus according to claim 1, wherein the correction value update unit updates the correction value within a predetermined correction range of the control frequency.

* * * * *